US006969056B2

(12) United States Patent
Sato et al.

(10) Patent No.: US 6,969,056 B2
(45) Date of Patent: Nov. 29, 2005

(54) CLAMPING DEVICE

(75) Inventors: Toshio Sato, Tsukuba-gun (JP); Akira Tadano, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 106 days.

(21) Appl. No.: 10/706,085

(22) Filed: Nov. 13, 2003

(65) Prior Publication Data

US 2004/0150150 A1 Aug. 5, 2004

(30) Foreign Application Priority Data

Jan. 15, 2003 (JP) ..... 2003-007352

(51) Int. Cl.[7] ..... B25B 1/06
(52) U.S. Cl. ..... 269/216; 269/224; 269/221; 269/222
(58) Field of Search ..... 269/220, 221, 269/222, 228, 32, 216

(56) References Cited

U.S. PATENT DOCUMENTS 4,635,911 A * 1/1987 Lovrenich ..... 269/224

FOREIGN PATENT DOCUMENTS

| | | |
|---|---|---|
| JP | 2001-9741 | 1/2001 |
| JP | 2001-105332 | 4/2001 |
| JP | 2001-310225 | 11/2001 |

* cited by examiner

*Primary Examiner*—Robert C. Watson
(74) *Attorney, Agent, or Firm*—Oblon, Spivak, McClelland, Maier & Neustadt, P.C.

(57) ABSTRACT

A first clamping arm mounted to an arm rotary shaft is rotated by a driving mechanism formed of a worm wheel mounted to the arm rotary shaft, a worm supported on a junction frame, and a first driving source to clamp a workpiece between a second clamping arm and the first clamping arm. A rotating force in a direction opposite to a reaction force in clamping is applied by a clamping force applying mechanism to the junction frame which has been displaced through a certain angle by the reaction force to thereby generate a rotating force in a clamping direction in the arm rotary shaft through the worm and the worm wheel to thereby apply a clamping force to the first clamping arm.

12 Claims, 5 Drawing Sheets

CLAMPING DEVICE

TECHNICAL FIELD

The present invention relates to a clamping device for clamping a workpiece for subjecting the workpiece to various kinds of processing.

BACKGROUND ART

In an automatic assembly line or the like in the automobile industry, for example, a workpiece is clamped in a clamping device for subjecting the workpiece to welding and other various kinds of processing. As such a clamping device, there are already-known devices as disclosed in patent documents 1, 2, and 3, for example. In each of these clamping devices, in general, a clamping arm is driven for rotation by a driving source and is moved to a predetermined clamping position which has been set in advance and then a large clamping force for clamping is generated by a toggle mechanism.

However, in the above prior-art clamping device, the position where the workpiece is clamped by the clamping arm has to be set in advance by adjusting the clamping device according to a size of the workpiece. Because the clamping position has been set according to the size of the workpiece, the clamping device needs to be stopped temporarily to reset the clamping position according to a size of a workpiece before clamping the workpiece of a different size. Moreover, when respective members forming a mechanism such as the toggle mechanism for transmitting a driving force from the driving source to the clamping arm wear as a result of repetition of operation, the clamping position is displaced and the workpiece cannot be clamped accurately. Therefore, the clamping device needs to be readjusted periodically to reset the clamping position.

As described above, in the conventionally-known clamping device, the above-described troublesome resetting operation of the clamping position is required so as to accurately clamp the workpiece in the clamping position by the clamping arm and an operation efficiency is decreased. They include the following:

(1) Patent Document 1 Japanese Patent Application Laid-open No. 2001-105332

(2) Patent Document 2 Japanese Patent Application Laid-open No. 2001-310225

(3) Patent Document 1 Japanese Patent Application Laid-open No. 2001-009741

DISCLOSURE OF THE INVENTION

It is a technical object of the present invention to provide a clamping device in which the above problem is solved, such that there is no need to carry out troublesome setting operation of a clamping position according to a size of a workpiece and wear of respective components, and operational efficiency can be improved.

To achieve the above objects, according to the present invention, there is provided a clamping device in which at least one of a pair of clamping arms, i.e., at least a first clamping arm is driven and rotated to clamp a workpiece between the other clamping arm, i.e., a second clamping arm and the first clamping arm, the device comprising: an arm rotary shaft rotatably supported on a clamp body and mounted with the first clamping arm; a clamp arm driving mechanism including a worm wheel mounted to the arm rotary shaft, a worm engaged with the worm wheel, and a first driving source for driving the worm; a junction frame supporting the worm and the first driving source and disposed to be able to turn around the arm rotary shaft independently of the arm rotary shaft; a clamping force applying mechanism for applying a rotating force in a direction opposite to a reaction force in clamping to the junction frame to thereby generate a rotating force in a clamping direction in the arm rotary shaft through the worm and the worm wheel engaged with each other to thereby apply a clamping force to the first clamping arm; and a sensor for outputting a signal when the sensor detects that the first clamping arm has come in contact with the workpiece to stop the first driving source and to cause the clamping force applying mechanism to operate.

In the clamping device having the above structure, if the first clamping arm is driven and rotated by the worm and the worm wheel to clamp the workpiece between the second clamping arm and the first clamping arm, the first driving source is stopped under a signal from the sensor and the first clamping arm stops in the clamping position. Then, the clamping force applying mechanism operates and the rotating force in the direction opposite to the reaction force in the clamping is applied to the junction frame. As a result, the rotating force in the clamping direction is applied to the arm rotary shaft from the worm supported on the junction frame through the worm wheel and the necessary clamping force is applied to the first clamping arm.

Thus, according to the invention, the first clamping arm is driven and rotated by the worm and the worm wheel and the rotating force is applied to the junction frame in a position where the workpiece is clamped to thereby apply the required clamping force to the first clamping arm through the worm and the worm wheel. Therefore, regardless of where a stop position of the first clamping arm occurs, i.e., where the clamping position is, the required clamping force can be generated to clamp the workpiece. In other words, irrespective of size of the workpiece, the workpiece can be clamped. Therefore, the troublesome setting operation of the clamping position which used to be carried out according to the size of the workpiece and wear of the respective components in prior art is not necessary and the operation efficiency is increased.

In the invention, the clamping force applying mechanism includes a clamp spring for generating a rotating force in the junction frame by action of a spring force and a second driving source for controlling the clamping spring, and the clamping spring is displaced by the second driving source to a position where the spring force acts on the junction frame and to a position where the spring force does not act on the junction frame.

In the invention, it is preferable that the clamping force applying mechanism further includes a transmitting shaft for moving forward and backward with respect to the junction frame and that the transmitting shaft is moved forward by the clamping spring to apply the spring force to the junction frame in clamping and is moved backward by the second driving source to displace the clamping spring to a non-actuated position in non-clamping.

According to a concrete structural form of the invention, the clamping spring is formed of a plurality of stacked disc springs, the transmitting shaft passes through a center of the stack of disc springs, one end of the stack of disc springs is in contact with a spring seat on the clamp body, and the other end is in contact with a shaft head portion at a tip end of the transmitting shaft. A "flexure-spring force" characteristic curve of the disc spring has a region in which the spring force is substantially constant with respect to flexure variation and it is preferable that the spring force in the region is applied to the junction frame.

According to a preferred structural form of the invention, a second driving source includes a solenoid for generating an electromagnetic attracting force by energizing a coil and a plunger to be attracted to the solenoid, and a base end portion of the transmitting shaft is connected to the plunger.

The junction frame is elastically pushed by a return spring in a direction against a reaction force in clamping and the sensor is mounted in a position on the clamp body and facing the junction frame and detects that the junction frame has been displaced against the return spring by action of the reaction force in clamping.

BEST MODES FOR CARRYING OUT THE INVENTION

Figure 1:
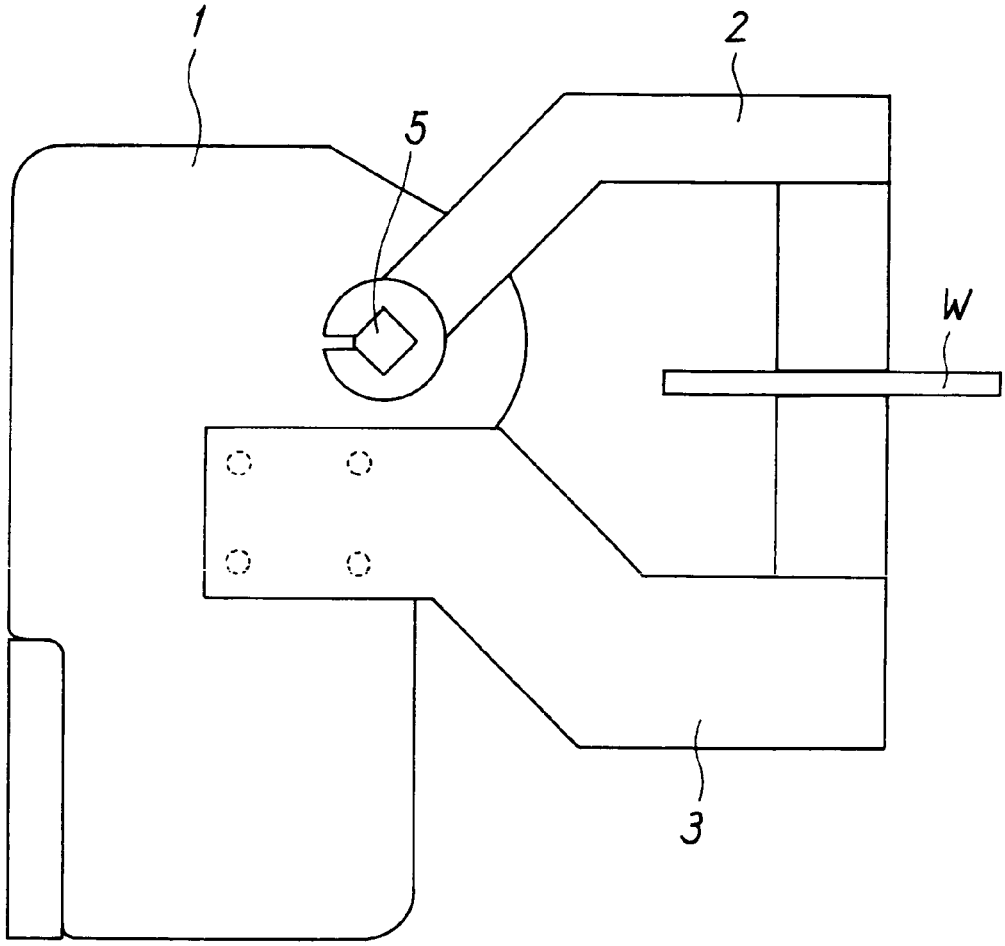
FIG. 1 is a front view of an embodiment of a clamping device according to the present invention.

FIGS. 1 to 4 show a preferred embodiment of a clamping device according to the present invention. The clamping device includes a clamp body 1, a first clamping arm 2 rotatably supported on the clamp body 1, and a fixedly-supported second clamping arm 3, and clamps a workpiece W between the first clamping arm 2 and the second clamping arm 3 by rotating the first clamping arm 2. A specific structure of the clamping device is as follows.

An arm rotary shaft 5 is rotatably supported on the clamp body 1 and a base end portion of the first clamping arm 2 is fixedly mounted to the arm rotary shaft 5. Mounted inside of the clamp body 1 are a clamp arm driving mechanism 6 for driving and rotating the first clamping arm 2 to a clamping position (see FIG. 4) and a non-clamping position (see FIG. 2) through the arm rotary shaft 5 and a clamping force applying mechanism 7 for applying a necessary clamping force to the first clamping arm 2 which has come in contact with the workpiece Win the clamping position.

The clamp arm driving mechanism 6 includes a worm wheel 10 fixedly mounted to the arm rotary shaft 5, a worm 11 engaged with the worm wheel 10, a first driving source 12 for driving the worm 11, and a transmission mechanism 13 for transmitting a rotating force of the first driving source 12 to the worm 11. The worm 11, the first driving source 12, and the transmission mechanism 13 are supported on a junction frame 14. The junction frame 14 is disposed so as to be able to turn around the arm rotary shaft 5 independently of the arm rotary shaft 5. The worm 11 and the first driving source 12 are mounted to be adjacent to each other on the junction frame 14, and an output shaft 12*a* of the first driving source 12 and a rotary shaft 11*a* la of the worm 11 are connected by a plurality of spur gears 13*a* forming the transmission mechanism 13.

The junction frame 14 is provided with a lever 14*a* which branches off toward the clamping force applying mechanism 7. Between the lever 14*a* and a spring seat 16 fixed to the clamp body 1, a return spring 17 is disposed. By this return spring 17, the junction frame 14 is elastically pushed in such a direction as to oppose a reaction force acting on the junction frame 14 in clamping of the workpiece W. The first driving source 12 is formed of an electric motor.

Figure 2:
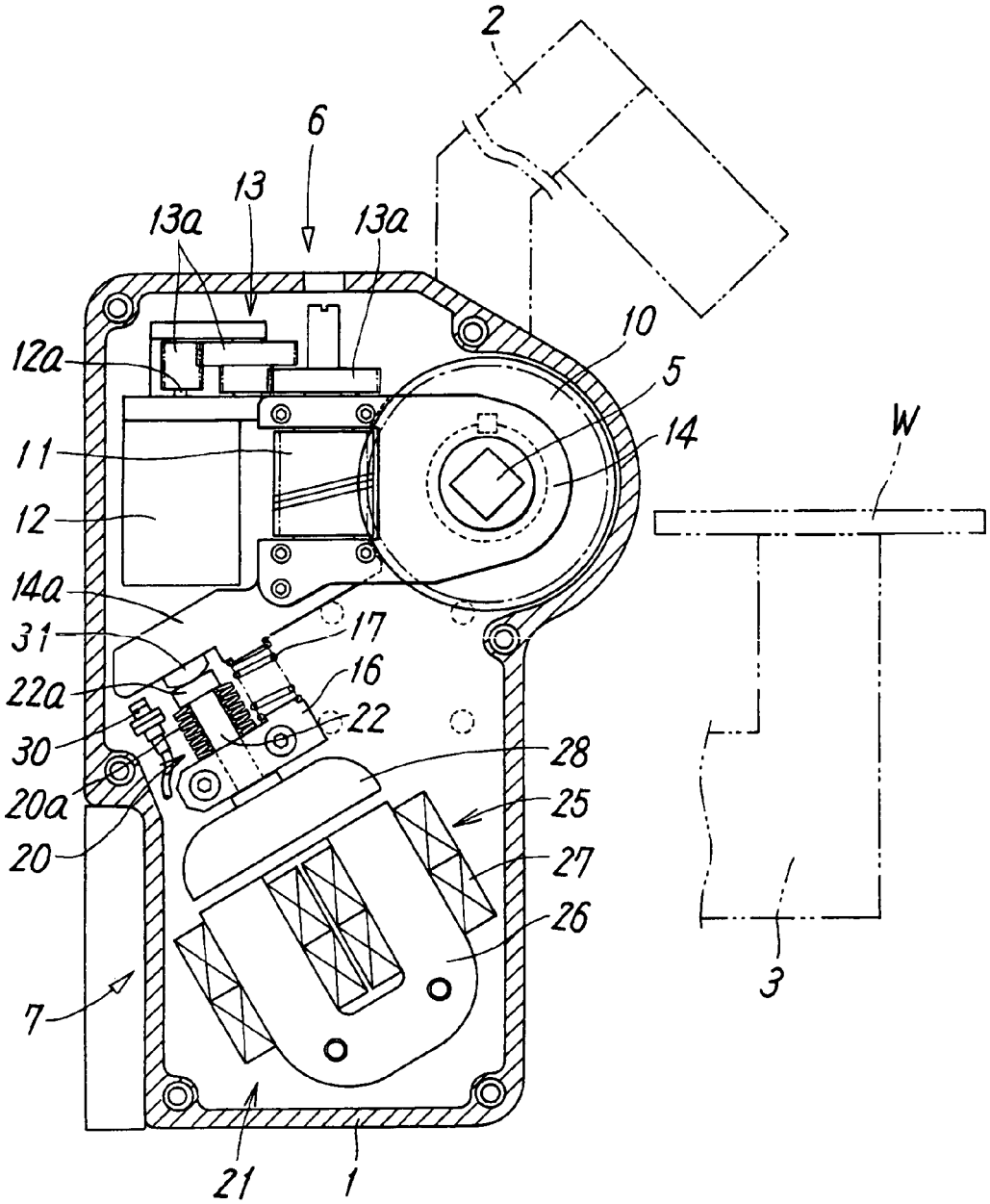
FIG. 2 is a sectional view of FIG. 1 and shows anon-clamping state.

In the clamp arm driving mechanism 6, if the worm 11 is driven in a normal direction by the first driving source 12 through the transmission mechanism 13 from a state shown in FIG. 2, the worm wheel 10 and the arm rotary shaft 5 rotate clockwise. As a result, the first clamping arm 2 turns toward the clamping position in FIG. 4, comes in contact with the workpiece W, and clamps the workpiece W between the first clamping arm 2 and the second clamping arm 3. If the worm 11 is driven in a reverse direction by the first driving source 12 from a state in FIG. 4, the worm wheel 10 and the arm rotary shaft 5 rotate counterclockwise. As a result, the first clamping arm 2 turns toward the non-clamping position in FIG. 2 and releases the workpiece W.

When the first clamping arm 2 turns to the clamping position and comes in contact with the workpiece W as described above, the first clamping arm 2 stops in the position. Therefore, the reaction force from the worm wheel 10 acts on the worm 11 and with this reaction force the worm 11 and the junction frame 14 supporting the worm 11 turn counterclockwise around the arm rotary shaft 5 while compressing the return spring 17.

The clamping force applying mechanism 7 includes a clamping spring 20 for applying a spring force to the lever 14*a* of the junction frame 14, a second driving source 21 for controlling the clamping spring 20, and a transmitting shaft 22 for relating the clamping spring 20 to the second driving source 21. The clamping spring 20 is formed by stacking a plurality of annular disc springs 20*a* alternately in opposite orientations. The transmitting shaft 22 passes through a center of the stack of disc springs, a large-diameter shaft head portion 22*a* at a tip end of the transmitting shaft 22 is in contact with one end of the stack of disc springs from outside, and the other end of the stack of disc springs is in contact with the spring seat 16. Therefore, the stack of disc springs, i.e., the clamping spring 20 is sandwiched between the shaft head portion 22*a* of the transmitting shaft 22 and the spring seat 16. The transmitting shaft 22 is slidably supported on the spring seat 16 and moves forward and backward with respect to the lever 14*a* of the junction frame 14.

On the other hand, the second driving source 21 is for moving the transmitting shaft 22 forward and backward by utilizing an electromagnetic attracting force and includes a solenoid 25 formed by winding a coil 27 around a U-shaped yoke 26 and a plunger 28. By the electromagnetic attracting force generated by energization of the coil 27, the plunger 28 is attracted to the yoke 26. Abase end portion of the transmitting shaft 22 is connected to the plunger 28.

Figure 3:
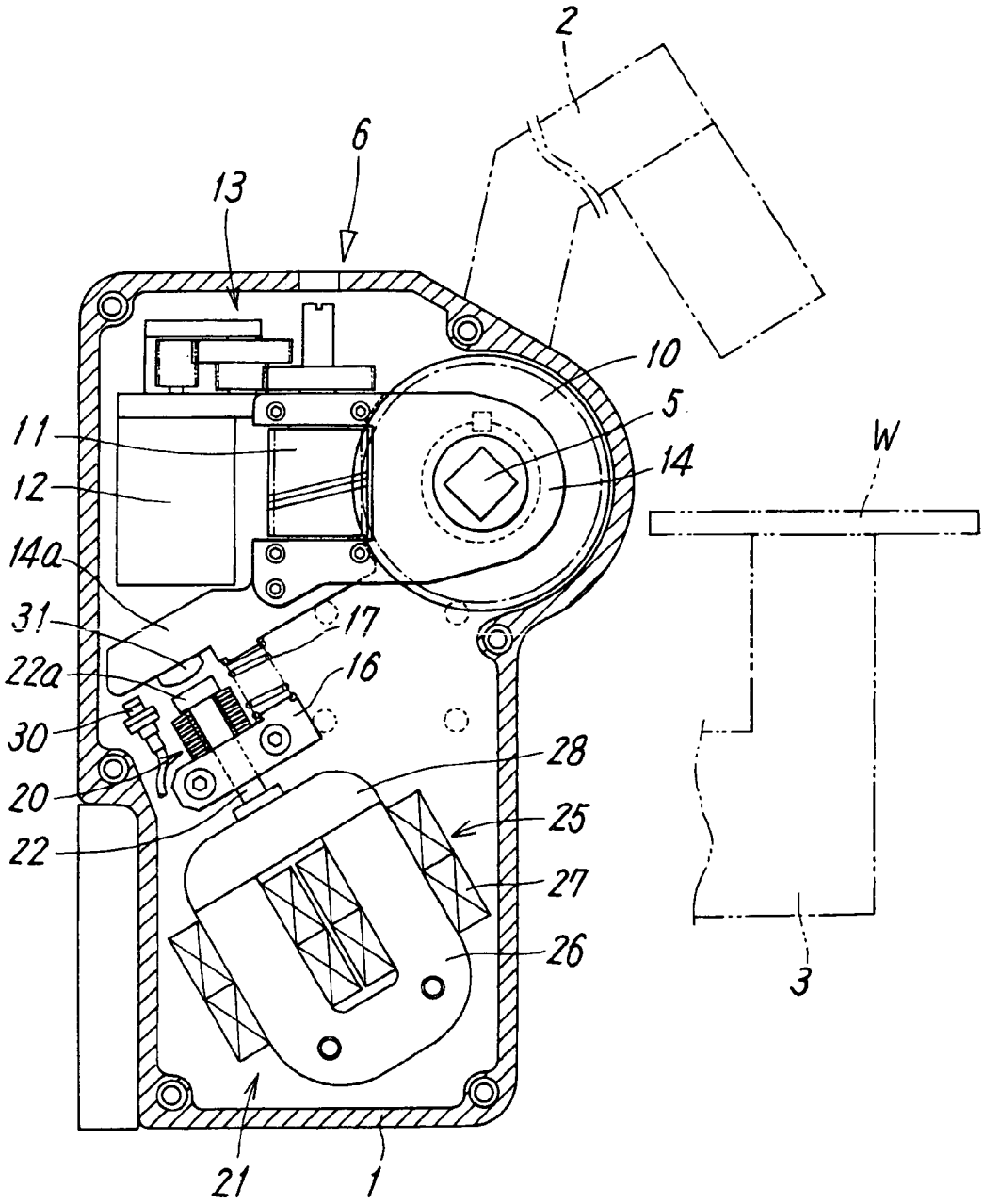
FIG. 3 is a sectional view of FIG. 1 and shows a state during progress of clamping.

Therefore, in the clamping force applying mechanism 7, when the coil 27 is not energized, the plunger 28 separates from the yoke 26 and the transmitting shaft 22 is moved forward by the spring force of the clamping spring 20 as shown in FIG. 2. At this time, the transmitting shaft 22 can move forward to a position of a stroke end where the plunger 28 comes in contact with the spring seat 16. On the other hand, when the coil 27 is energized, because the plunger 28 is attracted to the yoke 26, the transmitting shaft 22 also moves backward, the clamping spring 20 is compressed between the shaft head portion 22*a* and the spring seat 16, and the spring force for applying the clamping force is built up in the clamping spring 20 as shown in FIG. 3.

In the clamp body 1, a sensor 30 is mounted in a position facing a tip end portion of the lever 14*a* of the junction frame 14. The sensor 30 is a proximity sensor and detects displacement of the junction frame 14 through the lever 14*a* and outputs a detection signal when the junction frame 14 is displaced counterclockwise through a certain angle by action of the reaction force in clamping the workpiece W. Under this output signal, the clamp arm driving mechanism 6 is stopped and the clamping force applying mechanism 7 is actuated. In other words, in the clamp arm driving mechanism 6, energization of electric motor which is the first driving source 12 is stopped and driving of the first clamping arm 2 is stopped. In the clamping force applying mechanism 7, energization of the solenoid 25 is stopped to separate the plunger 28 from the yoke 26 and the spring force of the clamping spring 20 is applied to the junction frame 14 through the transmitting shaft 22.

Operation of the clamping device having the above structure will be described. FIG. 2 shows a state before clamping of the workpiece W. To clamp the workpiece W placed on the second clamping arm 3 from this state, the solenoid 25 of the clamping force applying mechanism 7 is first energized, the plunger 28 is attracted to the yoke 26 to thereby move the transmitting shaft 22 backward, and the clamping spring 20 is compressed to build up the spring force for applying the clamping force as shown in FIG. 3. At this time, because the shaft head portion 22*a* at the tip end of the transmitting shaft 22 is at a distance from a contact 31 formed on the lever 14*a* of the junction frame 14, the spring force of the clamping spring 20 does not act on the junction frame 14 and only the spring force of the return spring 17 acts clockwise on the frame 14. Therefore, the junction frame 14 occupies an initial position where the frame 14 has turned to a clockwise limit.

Figure 4:
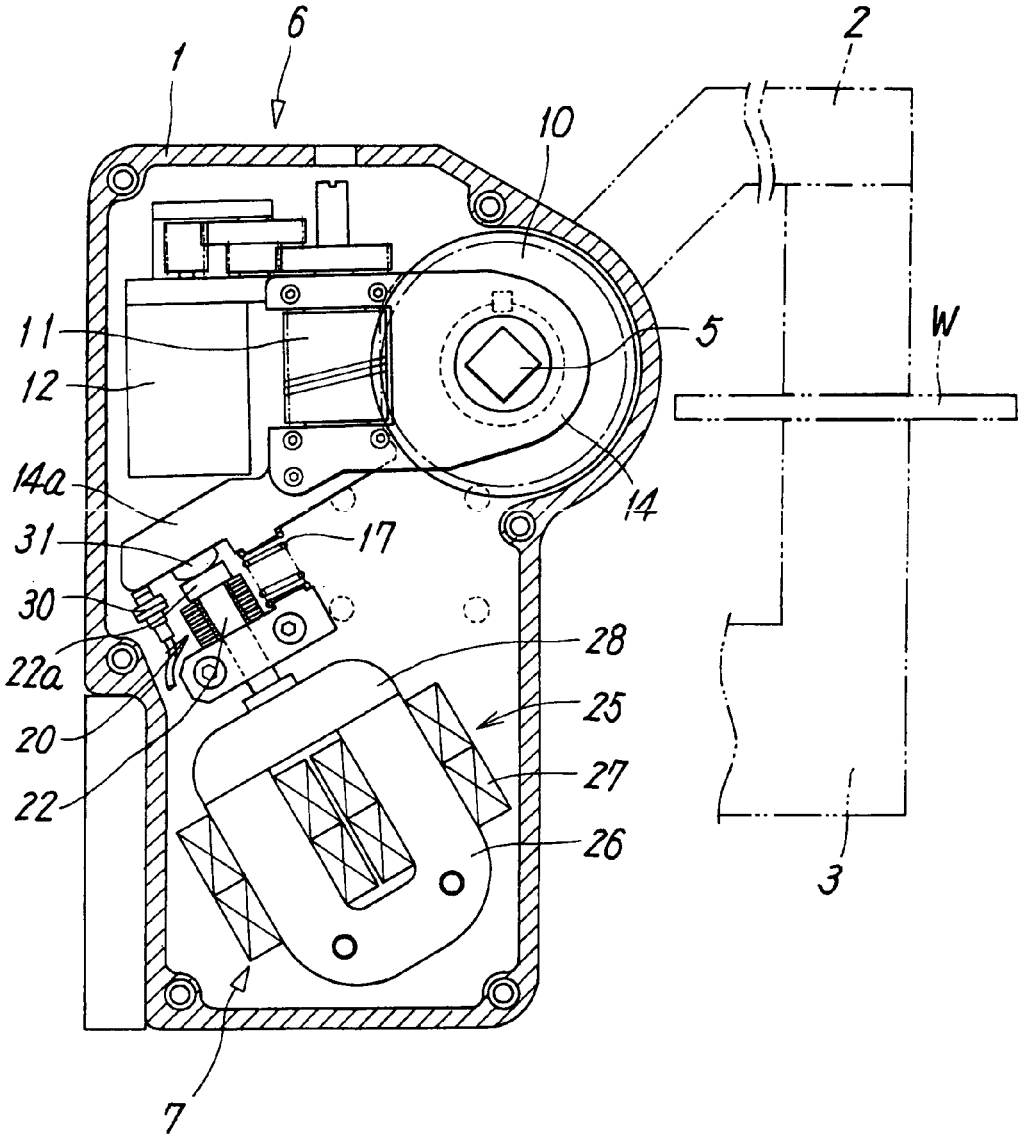
FIG. 4 is a sectional view of FIG. 1 and shows a clamping state.

Then, if the first driving source 12 is energized to drive the worm 11 in the normal direction, the worm wheel 10 is driven to turn the arm rotary shaft 5 clockwise. As a result, the first clamping arm 2 turns to the clamping position in FIG. 4 via a position in FIG. 3 and comes in contact with the workpiece W to clamp the workpiece W between the second clamping arm 3 and the first clamping arm 2. Then, when the first clamping arm 2 stops in the clamping position as it is, the reaction force from the worm wheel 10 acts on the worm 11. As a result, the junction frame 14 supporting the worm 11 turns around the arm rotary shaft 5 in a direction in which the reaction force acts, i.e., counterclockwise while compressing the return spring 17 and is displaced to an actuating position where the contact 31 of the lever 14*a* comes in contact with or close to the shaft head portion 22*a* of the transmitting shaft 22 as shown in FIG. 4.

If the junction frame 14 is displaced through the certain angle in the above manner, the displacement is detected by the sensor 30 through the lever 14*a*. Then, under the detection signal from the sensor 30, the first driving source 12 is stopped to stop driving of the first clamping arm 2 and energization of the solenoid 25 of the clamping force applying mechanism 7 is stopped. As a result, the plunger 28 is released from the yoke 26 and therefore the spring force of the clamping spring 20 acts on the junction frame 14 through the transmitting shaft 22 and a clockwise rotating force in a direction opposite to the reaction force in clamping is applied by this spring force to the junction frame 14. As a result, a rotating force in a clamping direction acts on the arm rotary shaft 5 through the worm wheel 10 from the worm 11 on the junction frame 14 and the clamping force required to clamp the workpiece W is applied by this rotating force to the first clamping arm 2.

Figure 5:
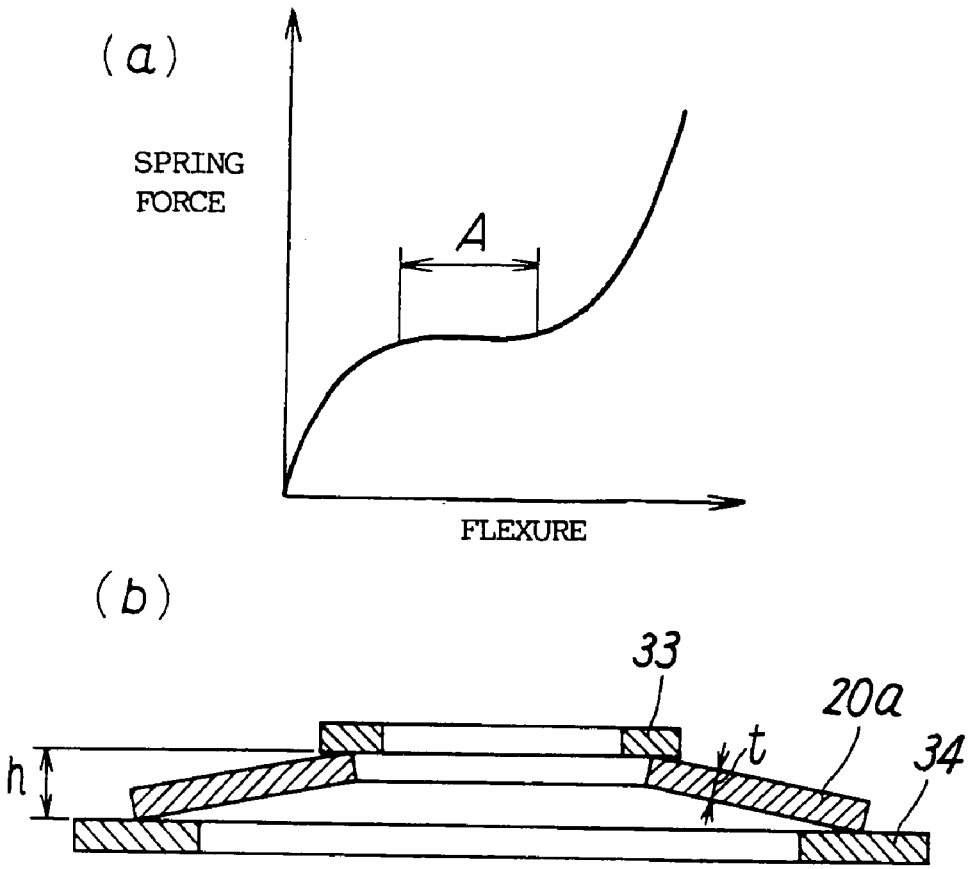
FIG. 5*a* is a diagram showing a characteristic of a disc spring used in a clamping force applying mechanism and FIG. 5*b* is a sectional view of an example of a structure of the disc spring showing the characteristic.

Here, each of the disc springs 20*a* forming the clamping spring 20 preferably has a region A in which the spring force is substantially constant and does not vary with respect to flexure variation in a "flexure-spring force" characteristic curve as shown in FIG. 5(*a*). By applying the spring force to the junction frame 14 in this region A, the clamping force can be kept substantially constant even if there are thickness differences between the workpieces W or if the workpiece is deformed in clamping.

The above characteristic curve can be obtained when the disc spring 20*a* is sandwiched between support plates 33 and 34 and a load is applied on the spring 20*a* as shown in FIG. 5(*b*), for example, and it is verified by an experiment that the region A can be obtained when a relationship between an effective height h and a plate thickness t of the disc spring 20*a* is about h/t= 1.4.

The load characteristic of the disc spring can be adjusted over a wide range in general not only by forming the spring on the above condition but also by combining a plurality of disc springs in parallel or series. Therefore, it is possible to properly select conditions on which the load is constant irrespective of the flexure.

To release the clamped workpiece W, the first driving source 12 drives the worm 11 in the reverse direction to rotate the worm wheel 10 in a reverse direction. Then, the arm rotary shaft 5 rotates counterclockwise and therefore the first clamping arm 2 turns toward the non-clamping position in FIG. 2 to release the workpiece W. The junction frame 14 also returns to the initial position by the elastic pushing force of the return spring 17.

Thus, in the clamping device having the above structure, the first clamping arm 2 is driven and rotated by the worm 11 and the worm wheel 10 and the rotating force is applied to the junction frame 14 in a position where the workpiece W is clamped to thereby apply the required clamping force to the first clamping arm 2 through the worm 11 and the worm wheel 10. Therefore, regardless of where the stop position of the first clamping arm 2 occurs, i.e., where the clamping position is, the required clamping force can be generated to clamp the workpiece W. In other words, irrespective of size of the workpiece W, the workpiece W can be clamped with the constant clamping force. Therefore, the troublesome setting operation of the clamping position which used to be carried out in prior art according to the size of the workpiece W and wear of the respective components is not necessary and the operation efficiency is increased.

Although only the first clamping arm 2 out of the pair of clamping arms 2 and 3 turns and the second clamping arm 3 is fixed in the above embodiment, it is also possible that the second clamping arm 3 also turns similarly or is displaced linearly. If the second clamping arm 3 turns, it is possible to attach a clamping force applying mechanism to the arm 3 similarly to the above-described first clamping arm 2.

According to the clamping device of the invention, there is no need to carry out the troublesome setting operation of the clamping position according to the size of the workpiece and the wear of the respective components and the operation efficiency is excellent.

What is claimed is:

1. A clamping device in which at least a first clamping arm is driven and rotated to clamp a workpiece between a second clamping arm and the first clamping arm, the device comprising:

an arm rotary shaft rotatably supported on a clamp body and mounted with the first clamping arm;

a clamp arm driving mechanism including a worm wheel mounted to the arm rotary shaft, a worm engaged with the worm wheel, and a first driving source for driving the worm;

a junction frame supporting the worm and the first driving source for turning around the arm rotary shaft independently of the arm rotary shaft;

a clamping force applying mechanism for applying a rotating force in a direction opposite to a reaction force in clamping to the junction frame to thereby generate a rotating force in a clamping direction in the arm rotary shaft through the worm and the worm wheel engaged with each other to thereby apply a clamping force to the first clamping arm; and a sensor for outputting a signal when the sensor detects that the first clamping arm has come in contact with the workpiece to stop the first driving source and to cause the clamping force applying mechanism to operate.

2. A clamping device according to claim 1, wherein the clamping force applying mechanism comprises a clamp spring for generating a rotating force in the junction frame by action of a spring force and a second driving source for controlling the clamping spring and the clamping spring is displaced by the second driving source to a position where the spring force acts on the junction frame and to a position where the spring force does not act on the junction frame.

3. A clamping device according to claim 2, wherein the clamping force applying mechanism further comprises a transmitting shaft for moving forward and backward with respect to the junction frame and the transmitting shaft is moved forward by the clamping spring to apply the spring force to the junction frame in clamping and is moved backward by a second driving source to displace the clamping spring to a non-actuated position in non-clamping.

4. A clamping device according to claim 3, wherein a tip end of the transmitting shaft has a shaft head portion, the clamp body includes a spring seat clamping spring comprising a plurality of stacked disc springs, the transmitting shaft passes through a center of the stack of disc springs, a first end of the stack of disc springs is in contact with said spring seat on the clamp body, and a second end of the stack of disc springs is in contact with a shaft head portion at a tip end of the transmitting shaft.

5. A clamping device according to claim 4, wherein a flexure-spring force characteristic curve of the disc spring has a region in which the spring force is substantially constant with respect to flexure variation and the spring force in the region is applied to the junction frame.

6. A clamping device according to claim 3, wherein said second driving source comprises a solenoid for generating an electromagnetic attracting force by energizing a coil and a plunger for being attracted to the solenoid and wherein a base end portion of the transmitting shaft is connected to the plunger.

7. A clamping device according to claim 4, wherein said second driving source includes a solenoid for generating an electromagnetic attracting force by energizing a coil and a plunger for being attracted to the solenoid and wherein a base end portion of the transmitting shaft is connected to the plunger.

8. A clamping device according to claim 5, wherein said second driving source comprises a solenoid for generating an electromagnetic attracting force by energizing a coil and a plunger for being attracted to the solenoid and wherein a base end portion of the transmitting shaft is connected to the plunger.

9. A clamping device according to claim 1, which comprises a return spring wherein the junction frame is elastically pushed by said return spring in a direction against a reaction force in clamping and the sensor is mounted on the clamp body facing the junction frame and detects when the junction frame has been displaced by action of the reaction force in clamping.

10. A clamping device according to claim 2, which comprises a return spring wherein the junction frame is elastically pushed by said return spring in a direction against a reaction force in clamping and the sensor is mounted in a position on the clamp body and facing the junction frame and detects when the junction frame has been displaced by action of the reaction force in clamping.

11. A clamping device according to claim 3, which comprises a return spring wherein the junction frame is elastically pushed by said return spring in a direction against a reaction force in clamping and the sensor is mounted in a position on the clamp body and facing the junction frame and detects when the junction frame has been displaced by action of the reaction force in clamping.

12. A clamping device according to claim 4, which comprises a return spring wherein the junction frame is elastically pushed by said return spring in a direction against a reaction force in clamping and the sensor is mounted in a position on the clamp body and facing the junction frame and detects when the junction frame has been displaced by action of the reaction force in clamping.

* * * * *